United States Patent [19]

Krüger et al.

[11] 3,971,912

[45] July 27, 1976

[54] FIXING ARRANGEMENT FOR FUSING TOWER IMAGES

[75] Inventors: Wilm Krüger, Puchheim-Bahnhof; Günther Schatka, Pfaffenhofen; Joachim Pietruska, Furstenfeldbruck, all of Germany

[73] Assignee: AGFA-Gevaert, A.G., Leverkusen, Germany

[22] Filed: June 23, 1975

[21] Appl. No.: 589,067

[30] Foreign Application Priority Data

June 21, 1974 Germany ..... 2429734

[52] U.S. Cl. ..... 219/216; 219/388; 219/532; 338/279; 338/280; 338/316; 338/318

[51] Int. Cl.[2] ..... H05B 1/00; G03G 15/20

[58] Field of Search ..... 219/216, 388, 374, 375, 219/532; 338/283, 287, 288, 289, 290, 291, 295, 274, 280, 315–316, 318–320; 13/25

[56] References Cited

UNITED STATES PATENTS

| | | | |
|---|---|---|---|
| 3,019,324 | 1/1962 | Sohn | 338/316 X |
| 3,673,387 | 6/1972 | Drugmand et al. | 338/280 X |
| 3,826,892 | 7/1974 | Draugelis et al. | 219/216 |

*Primary Examiner*—C. L. Albritton
*Attorney, Agent, or Firm*—Michael J. Striker

[57] ABSTRACT

In a copying machine a toner-image-bearing copy carrier moves in a predetermined direction along a predetermined path. A fixing arrangement fixes toner images by fusing the toner thereof. The fixing arrangement includes a heating winding having a plurality of turns and a holding arrangement for holding the heating winding. The holding arrangement comprises a plurality of discrete holding units each engaging and holding at least one respective one of the turns of the winding. The discrete holding units are arranged in two spaced groups. The turns of the heating winding extend in a plurality of stretches from one group of holding units to the other in the direction of the transport path and serve to heat the toner on copy carriers passing therealong.

11 Claims, 2 Drawing Figures

Fig. 2
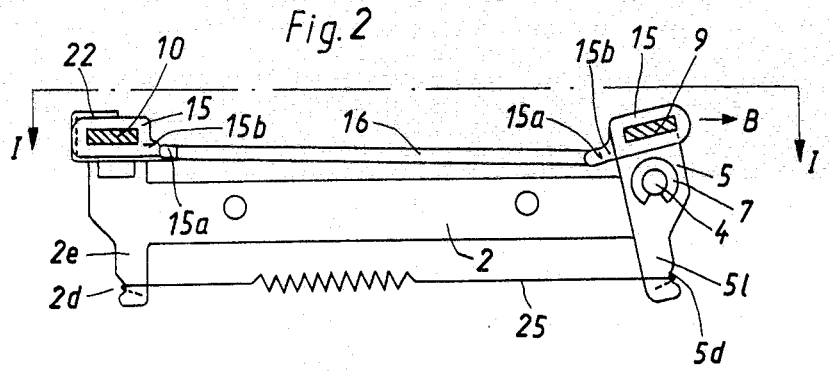
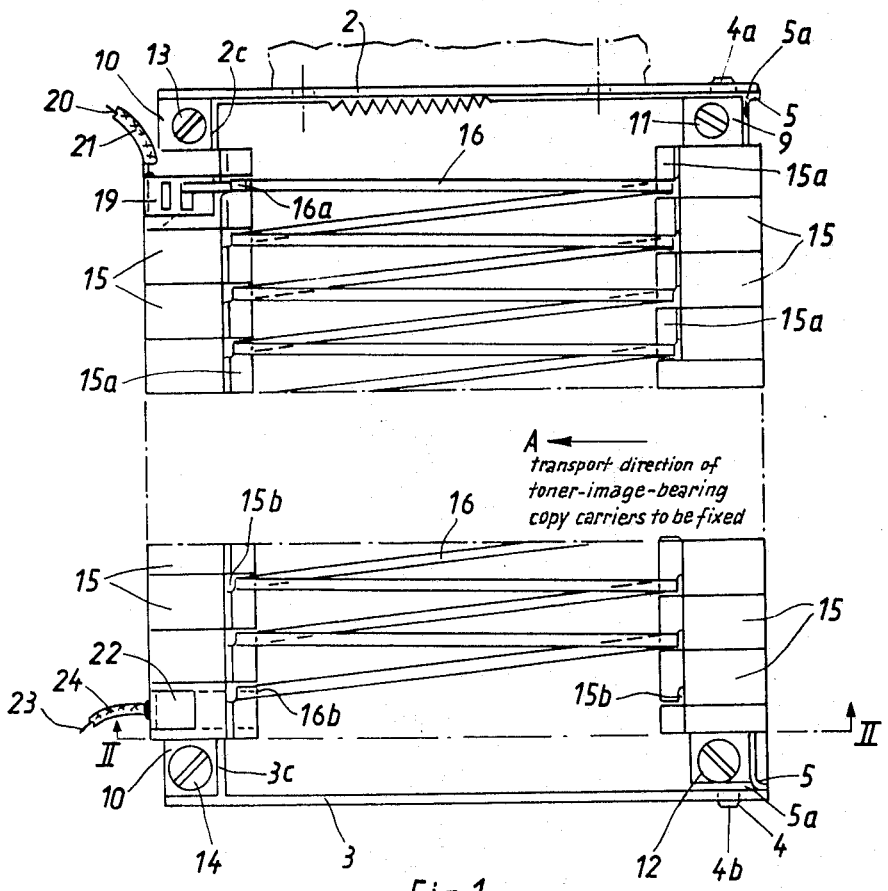
Fig. 1
WILM KRÜGER
GÜNTHER SCHATKA
JOACHIM PIETRUSKA

FIXING ARRANGEMENT FOR FUSING TOWER IMAGES

BACKGROUND OF THE INVENTION

The invention relates to fixing arrangements for fusing the toner of toner images by means of heating wires stretched between holding rails and extending in the direction of the transport path of the toner images.

With known fixing arrangements of this type, a plurality of discrete heating elements, such as metal strips, are each separately secured in a clamping arrangement by means of tightening screws. As a result, the assembly of such a fixing arrangement, and in particular the securing in position of the heating elements, is relatively time-consuming and accordingly involves a considerable labor cost.

SUMMARY OF THE INVENTION

It is a general object of the invention to provide a fixing arrangement in which the assembly of the heating element is simpler and accordingly involves a lower labor cost than in the prior art.

This object, and others which will become apparent from the description, below, of a preferred embodiment, can be met, according to one advantageous concept of the invention, if the plurality of heating wires are formed as parts of a single heating winding, and if ceramic holding bodies provided with holding portions each serving to hold at least one turn of the heating coil are strung onto holding rails. Preferably, on the ceramic bodies the holding portions for the turns of the heating winding are provided in the form of holding hooks which define holding openings which are open at the free ends of the respective hooks for receipt of a turn of the heating winding, but which are closed off when after the insertion of the respective turn of the winding the next such ceramic body is strung onto the respective one of the holding rails.

In this way, there is achieved the advantage that the securing of the resistive heating wire requires merely the hooking of successive turns of the wire onto the holding hooks of successive ones of the ceramic bodies. After all the ceramic bodies have been slid onto the respective rails, the holding portions of the ceramic bodies are so spaced relative to the respective adjoining ceramic bodies as to preclude an exit of the turn of the winding from the opening formed between the respective holding portion and the remainder of the respective ceramic body.

A particularly simple and stable design for the inventive fixing arrangement results by providing two end plates arranged parallel to each other and to the transport direction of the toner image and by securing to these plates the opposite ends of a slide rail oriented transverse to such transport direction, and providing a further slide rail whose opposite ends are likewise secured to the end plates and which is likewise oriented transverse to the toner image transport direction, but with this latter slide rail being mounted on pivotable arms which are spring-biased in a direction tending to maintain constant the stressing of the resistive heating wire.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view of an embodiment of the invention, as viewed in the direction of the arrows I—I in FIG. 2; and FIG. 2 is a sectional end view of the embodiment of FIG. 1, the section being taken along the line II—II in FIG. 1.

DESCRIPTION OF THE PREFERRED EMBODIMENT

The fixing arrangement shown in FIGS. 1 and 2 includes two parallel end plates 2 and 3 oriented parallel to each other and to the transport direction A of a copy carrier bearing a powder image to be fixed. A rail 10 oriented transverse to the toner-image transport direction is connected to the end plates 2 and 3. In particular, the opposite ends of the rail 10 are secured to respective ones of bent tab portions 2*c*, 3*c* on the end plates 2, 3. A pivot shaft 4 connects together the right-hand ends of the plates 2, 3, passing through holding apertures in the plates. The end portions 4*a*, 4*b* of the pivot shaft 4 project past the holding apertures and serve to mount pivotable arms 5. The pivotable arms 5 and the pivot shaft 4 are held in place, in direction longitudinally of the shaft 4, by means of circlips 7 engaging the shaft 4, at the ends 4*a*, 4*b* thereof. The pivotable arms 5 have bent-over tab portions 5*a* to which are connected by means of screws 11, 12 respective ones of the opposite ends of a further rail 9 likewise oriented transverse to the toner-image transports direction A.

The upper pivotable arm 5 is provided with a projection 51 having a holding notch 5*d*. Likewise, the end plate 2 is provided with a projection 2*e* having a holding notch 2*d*. A tension spring 25 extends between the projections 2*e*, 51, its ends being received in and held by the holding notches 2*d*, 5*d*. The biasing force of tension spring 25 urges the pivotable arm 5 to turn in clockwise direction, as viewed in FIG. 2. Accordingly, the rail 9 is urged to move in the general direction of arrow B. As a result, the heating winding, which is stretched between the rails 9 and 10 in a manner described in detail below, assumes a stressed condition substantially independent of the temperature of the heating winding. In this way, loosening and drooping down of the heating winding when it is hot, so that it comes into contact with a toner-image-bearing copy carrier travelling in a plane parallel to the picture plane of FIG. 1, is prevented.

A plurality of ceramic holding bodies 15 are successively slid onto each of the rails 9, 10. Each ceramic holding body 15 is provided with an integral holding hook 15*a* which defines with the remainder of the respective ceramic body 15 a holding opening 15*b* which is open at the free end of the respective holding hook 15*a*. Each turn of a strip-shaped heating winding 16 is inserted into the holding opening 15*b* and passed around the holding hook 15*a* of a respective one of the ceramic bodies 15. After a turn of the heating 16 is inserted into one of the holding openings 15*b* and passed around the respective holding hook 15*a*, the next (in FIG. 1, the next lower) ceramic body 15 is slid onto the rail 9 or 10. The surface of such next ceramic body 15 which adjoins the opening intermediate the holding hook 15*a* and the remainder of the previously slid-on ceramic body 15 in effect closes off such opening, thereby preventing removal or exit of the accommodated turn of the winding.

To assemble the heating winding 16, one starts with a winding 16 having approximately the bent configuration shown. One then hooks the holding hook 15*a* of one of the ceramic bodies 15 into one turn of the winding 16, and then slides such ceramic body 15 onto the slide rail 9 or 10, preferably alternating between the rails 9 and 10. After all the ceramic bodies 15 have been slid onto the rails 9 and 10, the rails 9 and 10 are secured by means of the screws 11–14 to the end plates 2, 3 or to the pivotable arms 5.

When the rails 9, 10 are screwed to the end plates 2, 3 and to the pivotable arms 5, the respective bent tab portions 2*c*, 3*c*, 5*a* of the end plates 2, 3 and pivotable arms 5, which abut against the four end ones of the ceramic bodies 15, prevent separation of the ceramic bodies 15 from each other, and accordingly prevent undesired freeing of the hooked turns of the winding 16.

Finally, the ends 16*a*, 16*b* of the winding 16 are electrically connected to metal claps 19, 22 clipped onto the end ones of the ceramic bodies 15 on the rail 10. Electrical leads 20, 21 and 23, 24 are connected to respective ones of the two metal clasps 19 and 22.

It will be understood that each of the elements described above, or two or more together, may also find a useful application in other types of constructions differing from the types described above.

While the invention has been illustrated and described as embodied in a toner-image-fixing arrangement making use of only a single heating winding 16, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a copying machine wherein a toner-image-bearing copy carrier moves in a predetermined direction along a predetermined transport path, an arrangement for fixing toner images by fusing the toner thereof, comprising, in combination, a heating winding having a plurality of turns; and holding means comprising a plurality of discrete holding units each engaging and holding at least one respective one of said turns, said discrete holding units being arranged in two spaced groups, and said turns of said heating winding extending in a plurality of stretches from one group to the other in the direction of said transport path for heating the toner on copy carriers passing therealong, wherein said discrete holding units of the one group are arranged in a first row and those of the other group in a second row parallel to and spaced from said first row, with both rows extending transverse to the direction of said transport path, wherein said discrete holding units are each provided with a holding portion defining a holding opening through which passes one of the turns of said heating winding, the opening having an unblocked end, and wherein the discrete holding units of each of said rows are so configurated and disposed relative to each other that the unblocked end of each holding unit is blocked off by the material of an adjoining holding unit to an extent preventing falling out of the respective turn of said heating winding.

2. In a copying machine wherein a toner-image-bearing copy carrier moves in a predetermined direction along a predetermined transport path, an arrangement for fixing toner images by fusing the toner thereof, comprising, in combination, a heating winding having a plurality of turns; and holding means comprising a plurality of discrete holding units each engaging and holding at least one respective one of said turns, said discrete holding units being arranged in two spaced groups, and said turns of said heating winding extending in a plurality of stretches from one group to the other in the direction of said transport path for heating the toner on copy carriers passing therealong, wherein said holding means comprises a pair of rails, and wherein the discrete holding units of one of said two spaced groups are supported by one of said rails and those of the other of said groups supported by the other of said rails, wherein said discrete holding units are discrete ceramic holding bodies, wherein said ceramic holding bodies are each provided with a holding opening through which passes and in which is held at least one respective turn of said heating winding, said ceramic holding bodies being so configurated and disposed on said rails that the holding opening of each ceramic holding body is blocked off by the adjoining holding body to an extent preventing the held turn of said heating winding from dropping off.

3. In a copying machine wherein a toner-image-bearing copy carrier moves in a predetermined direction along a predetermined transport path, an arrangement for fixing toner images by fusing the toner thereof, comprising, in combination, a heating winding having a plurality of turns; and holding means comprising a plurality of discrete holding units each engaging and holding at least one respective one of said turns, said discrete holding units being arranged in two spaced groups, and said turns of said heating winding extending in a plurality of stretches from one group to the other in the direction of said transport path for heating the toner on copy carriers passing therealong, wherein said holding means comprises a pair of rails, and wherein the discrete holding units of one of said two spaced groups are supported by one of said rails and those of the other of said groups supported by the other of said rails, wherein said discrete holding units are discrete ceramic holding bodies, wherein said holding means further includes two end plates oriented parallel to each other and to the direction of said transport path, one of said rails being fixedly secured between said end plates and extending in direction transverse to the direction of said transport path, and further including a pivotable arm on each of said end plates, the other of said rails being secured between said pivotable arms and extending in direction transverse to the direction of said transport path, and a tension spring connected to at least one of said pivotable arms for urging the arm to pivot in a direction causing the associated rail to move apart from the other rail to maintain the stretches of said winding stressed despite heating up of said winding.

4. In a copying machine wherein a toner-image-bearing copy carrier moves in a predetermined direction along a predetermined transport path, an arrangement for fixing toner images by fusing the toner thereof, comprising, in combination, a heating winding having a plurality of turns; and holding means comprising a plurality of discrete holding units each engaging and holding at least one respective one of said turns, said discrete holding units being arranged in two spaced groups, and said turns of said heating winding extending in a plurality of stretches from one group to the other in the direction of said transport path for heating the toner on copy carriers passing therealong, wherein said discrete holding units are each provided with a holding portion defining a holding opening through which passes one of the turns of said heating winding, the opening having unblocked end, and wherein the discrete holding units of each of said groups are so configurated and disposed relative to each other that the unblocked end of each holding unit opening is blocked off by the material of an adjoining holding unit to an extent preventing falling out of the respective turn of said heating winding.

5. In a copying machine as defined in claim 4, wherein said holding means comprises a pair of rails, and wherein the discrete holding units of one of said two spaced groups are supported by one of said rails and those of the other of said groups supported by the other of said rails.

6. In a copying machine as defined in claim 4, wherein said discrete holding units are discrete ceramic holding bodies.

7. In a copying machine as defined in claim 2, wherein said discrete holding units of the one group are arranged in a first row and those of the other group in a second row parallel to and spaced from said first row, with both rows extending transverse to the direction of said transport path.

8. In a copying machine as defined in claim 4, wherein the turns of said heating winding extend in stretches which zig-zag back and forth from one to the other of said groups of discrete holding units.

9. In a copying machine as defined in claim 1, wherein each of said plurality of discrete holding units is provided with an integral holding hook constituting said holding portion, and wherein the holding hook together with the remainder of the respective holding unit defines an intermediate space constituting said holding opening.

10. In a copying machine as defined in claim 2, wherein said holding means further includes biasing means urging said rails apart to maintain the stretches of said winding stressed despite heating up of said winding.

11. In a copying machine as defined in claim 4, wherein said holding means further includes biasing means urging said groups apart from each other to maintain the stretches of said winding stressed despite heating up of said winding.

* * * * *